United States Patent [19]

Lovison et al.

[11] 4,193,209

[45] Mar. 18, 1980

[54] FINGERNAIL DRYER

[76] Inventors: Paula J. Lovison, 916 N. First St. #E, Alhambra, Calif. 91801; William D. Lovison, 260 Colusa Way, Vista, Calif. 92083

[21] Appl. No.: 946,545

[22] Filed: Sep. 28, 1978

[51] Int. Cl.[2] ..... F26B 21/00

[52] U.S. Cl. ..... 34/239; 34/202; 416/63; 416/247 R

[58] Field of Search ..... 34/202, 239, 90, 91; 416/63, 247 R

[56] References Cited

U.S. PATENT DOCUMENTS

| | | | |
|---|---|---|---|
| 2,374,472 | 4/1945 | Corbett | 34/239 X |
| 3,085,350 | 4/1963 | Waters | 34/91 |
| 3,963,382 | 6/1976 | Patton | 416/247 R |

*Primary Examiner*—Edward G. Favors

[57] ABSTRACT

A mechanical device for assisting in the application of fingernail polish or enamel, and subsequent drying, makes use of a housing containing an electrically operated fan which moves an air stream upwardly through the housing and out the top. A bracket serving as a hand rest and finger support having a specially constructed attachment to the housing is movable to a position above the air stream where its attachment releasably retains the bracket in finger supporting position and in the air stream. The specially constructed attachment is such that when the bracket is thus positioned an extension of it on opposite sides, protruding beyond the housing, elevates the housing above a supporting surface on which it may rest to assure an abundant supply of air to the fan. When not needed as a hand rest in finger supporting position, the bracket pivots to an endwise location where it can serve as a carrying handle.

6 Claims, 5 Drawing Figures

Fig. 2.
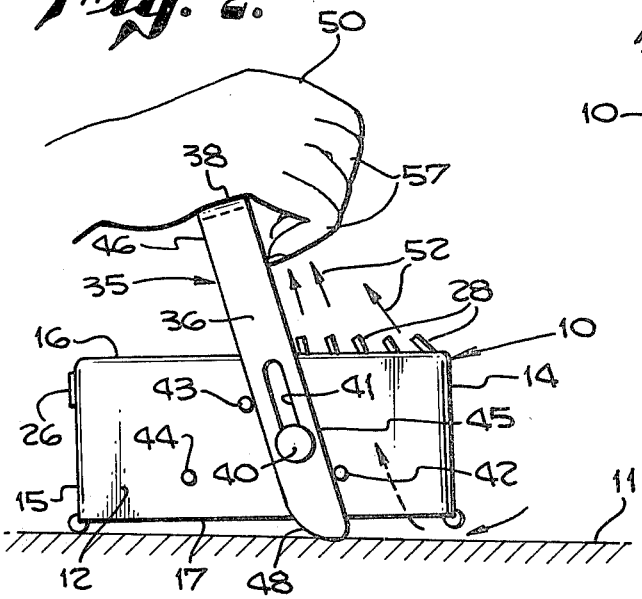
Fig. 1.
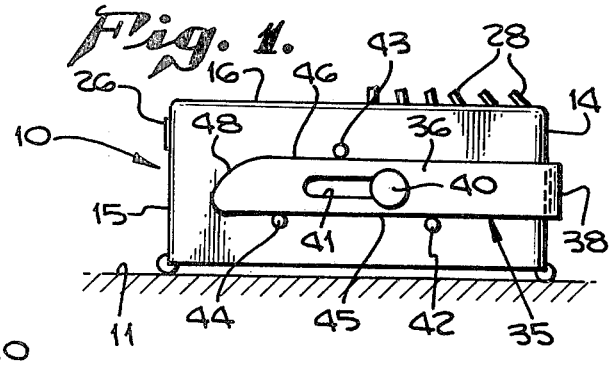
Fig. 3.
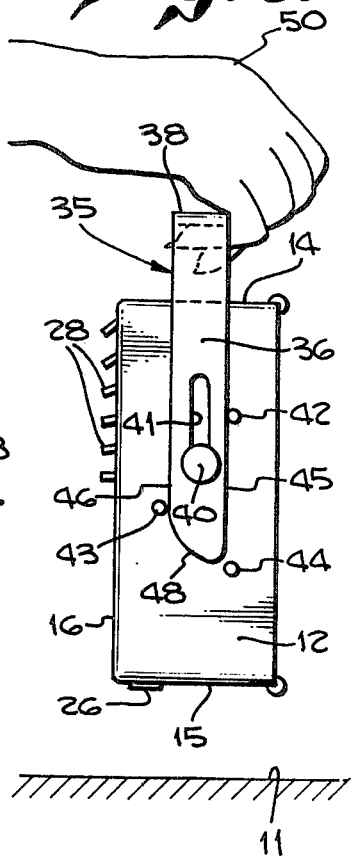
Fig. 4.
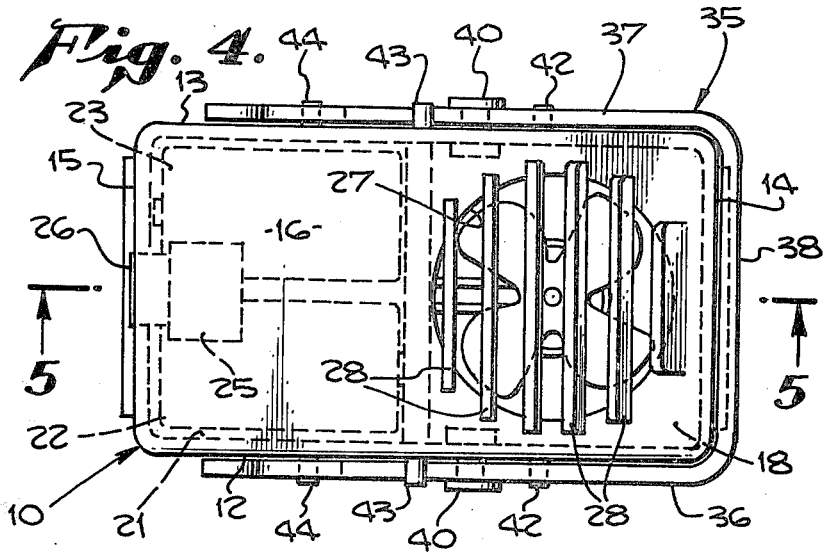
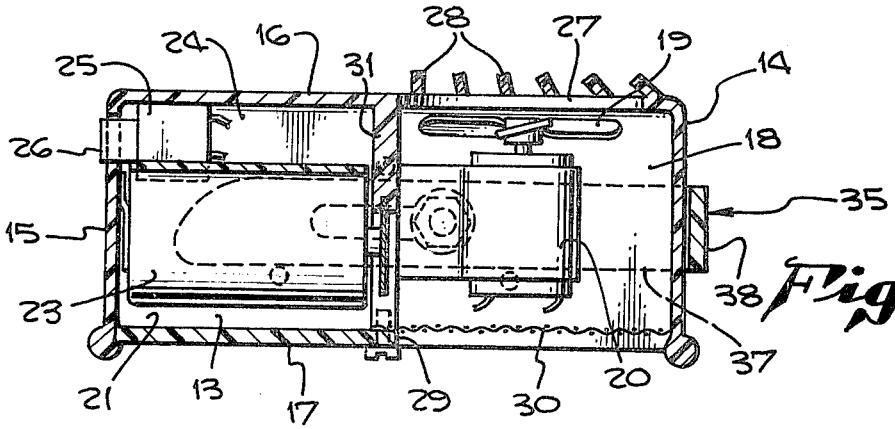
Fig. 5.

FINGERNAIL DRYER

The prevailing practice, long in vogue, of enameling and polishing fingernails has continued to be confronted with troublesome inconveniences. The inconveniences persist inspite of the employment of fast drying enamels. The manicurist, whether it be the person involved or an assistant, can apply fingernail enamel accurately and rapidly only if the finger is held steady. Furthermore, as the application progresses from one finger to another, there is always the hazard of smearing one or another fingernail to which enamel has already been applied while application is being made to one or another of those next in order. If the procedure undertakes to allow each fingernail in turn to dry completely, then application of the enamel to all of the fingers consumes an inordinate amount of time. Despite the quick-drying times claimed by suppliers, a certain and needed amount of drying time is inevitable. In damp weather the drying time is appreciably increased.

While it may be true that make-shift dryers can be employed to speed up the drying time whereby air may be blown over the fingernails by one mechanism or another, the hazard of smear continues to exist. If no mechanical drying at all is resorted to then the drying time is appreciably increased, even though the subject may attempt to assist the drying by moving the hands or perhaps blowing on the fingernails.

It is therefore among the objects of the invention to provide a new and improved mechanical fingernail dryer which provides a convenient and advantageous support for the fingers in precisely the proper position while the drying progresses.

Another object of the invention is to provide a new and improved mechanical fingernail dryer which incorporates a support for the hand and fingers which serves equally well both for application of the enamel to the nails in the first place and the drying operation which follows immediately thereafter.

Another object of the invention is to provide a new and improved power-operated mechanical fingernail dryer which is small, compact and inexpensive and which makes use of a hand and finger support which serves a multiple purpose namely that of additionally setting the power actuated mechanism in position where an abundance of drying air is assured.

Another object of the invention is to provide a new and improved power actuated fingernail drying device provided with an adjustable support for the hand and fingers both during initial application of the enamel and subsequent drying and which serves further purposes of, not only assuring an abundance of air for drying purposes, but also which serves as a carry handle which may, if desired, be compactly stowed, in order to take up a minimum amount of space when not in use.

With these and other objects in view, the invention consists of the construction, arrangement, and a combination of the various parts of the device serving as an example only of one or more embodiments of the invention, whereby the objects contemplated are attained, as hereinafter disclosed in the Specification and drawings, and pointed out in the appended claims.

FIG. 1 is a side elevational view of the device in resting position.

FIG. 2 is a side elevational view of the device in operative position.

FIG. 3 is a side elevational view in position for carrying.

FIG. 4 is a top view.

FIG. 5 is a longitudinal cross-sectional view on the line 5—5 of FIG. 4.

In an embodiment of the invention chosen for the purpose of illustration, the invention is shown embodied in a housing 10 shown resting upon a supporting surface 11. The housing comprises sidewalls 12 and 13, endwalls 14 and 15, a topwall 16 and a bottom wall 17. The walls encompass a chamber 18 which houses an electric fan having fan blades 19 and a body 20. The walls also encompass a pocket 21 which houses two flashlight batteries 22 and 23. Above the pocket 21 is recess 24, electrically connected to the batteries and fan. A push-button 26 for operating the switch 25 is conveniently located on the endwall 15 near the topwall 16.

There is an outlet passage 27 in the topwall 16 immediately above the fan blades 19. Serving the outlet passage is a series of deflecting vanes 28, tilted in such fashion as to direct the flow 52 in a somewhat concentrated fashion. Serving the outlet passage is an inlet passage 29 located in the bottom wall 17 and covered by a protective mesh 30. A partition 31 separates the chamber 18 from the pocket 21 and the battery load being slightly heavier than the fan adds a degree of balance to the end of the housing remote from the fan.

Of special importance is the structure and location of a hand-supporting bracket indicated generally by the reference character 35. In the chosen embodiment the bracket 35 consists of legs 36 and 37 interconnected by a handrest 38.

For pivotally attaching the legs to the housing, there are provided studs 40 on each side of the housing, one for each of the legs 36 and 37. The stud is received in a pivot aperture in the form of a slot 41, extending lengthwise relative to the respective leg. To assist in positioning the legs there is provided on each of the sidewalls 12 and 13 a set of stop buttons 42, 43 and 44. These stop buttons are stationary projections on the respective sidewall which protrude outwardly a distance somewhat greater than the thickness of the leg of the bracket. The arrangement of stop buttons is such that the stop button 42 is on one side of the pivot axis identified by the stud 40 and the stop buttons 43 and 44 are on the opposite side.

As shown in FIGS. 1 and 3, the spacing of the stop buttons is such that when the bracket is in either the carrying position of FIG. 3 or in the stowed position of FIG. 2, the buttons 42 and 44 underly one side edge 45 of the leg 46, for example, and the other stop button 43 overlies the other edge 46 of the same leg, a position as shown in FIG. 1. The bracket is prevented from tilting by a pressure of the buttons 42 and 44 against the edge 45 at two different locations spaced on opposite sides of the stud 40, while at the same time being restrained by pressure of the stop button 43 on the opposite side. In the position of FIG. 3 a limited tilting in one direction or the other is permitted.

Of special consequence is the position of the bracket in FIG. 2. As there shown, the legs 36 and 37 are tilted so that the handrest 38 overlies the topwall 16 at a location slightly rearwardly of the outlet passage 27. This gives the legs a slightly oblique position as shown in FIG. 2. When titled to this position the leg 46, for example, rotates until the edge 45 engages against the stop button 42 and the edge 46 engages against the stop button 43, at the same time, the stud 40 moves to the end of the slot 41. The distance between the end of the slot and the end of the leg is such that with the end of the leg in engagement with the supporting surface 11, the end of the housing which contains the fan is lifted above the supporting surface a short distance sufficient to provide an abundant supply of air to the inlet passage 29. Curved camming surfaces 48 at the ends of the legs 36, 37 are for smoothly elevating the housing to the position of FIG. 2. In that position, which is a full operating position, a hand 50 of the operator can be rested on the handrest 38, and the fingers 51 allowed to extend downwardly to a position below the handrest immediately in the path 52 of air emerging from the outlet passage 27. Because of the tilt of the vanes, most of the air emerging from the outlet passage 27 is re-directed toward the ends of the fingers 51. This is an effective drying position for enamel or polish which has been applied to the fingernails. The bracket is additionally advantageous in that it extends to an effective and comfortable position where ends of the fingers 51 can rest on top of the handrest in an effective position for initial application of polish or enamel or for the application of a polish remover. The position of the bracket for effective application of the nail polish is the same as for drying. The push button 26 for the switch 25 is also conveniently located relative to the bracket in its position of operation, as is evident from FIG. 2.

We claim:

1. A cosmetic accessory device for the hands comprising a housing for use on a supporting surface, said housing having sidewall, topwall and bottomwall structures providing a chamber, a power actuated fan contained in said chamber, outlet passage means for said fan in one of said wall structures, a source of power for said fan and a switch mounted on said housing in operative relationship with said source of power, a hand supporting bracket comprising legs having opposite side edges, a hand rest extending between adjacent ends of the legs, opposite ends of the legs having each a pivotal connection to the housing on respective opposite sidewall structures, said bracket having a first position wherein said hand rest is in a hand supporting position located adjacent said outlet passage means wherein to support fingernails of a user's hand in successive positions for cleaning, for application of polish and for drying of said polish, and wherein said legs are in a position on the supporting surface, the pivotal connection of at least one of the legs comprising a releasable interlocking connection with said housing, said bracket having a second position wherein the hand rest is spaced from an adjacent sidewall structure and in a carrying position.

2. A cosmetic accessory device as in claim 1 wherein when the bracket is in said first position there are portions of the legs having an operative position protruding beyond the housing on the side opposite the hand rest for engagement with the supporting surface whereby to space the adjacent wall structure from said surface and wherein there is an air inlet passage means to said chamber in said wall structure adjacent said legs.

3. A cosmetic accessory device for the hands comprising a housing for use on a supporting surface, said housing having sidewall, topwall and bottomwall structures providing a chamber, a power actuated fan contained in said chamber, outlet passage means for said fan in one of said wall structures, a source of power for said fan and a switch mounted on said housing in operative relationship with said source of power, a hand-supporting bracket comprising legs having opposite side edges, a hand rest extending between adjacent ends of the legs, opposite ends of the legs having each a pivotal connection to the housing on respective opposite side wall structures, said hand rest having a hand-supporting first position located adjacent said outlet passage means wherein to support fingernails of a user's hand in successive positions for cleaning, for application of polish and for drying of said polish, the pivotal connection of at least one of the legs comprising a releasable interlocking connection with said housing, said hand rest having a carrying second position wherein the hand rest is spaced from an adjacent side wall structure, said pivotal connection for at least one of said legs comprising a pivot pin, a complementary pivot aperture, and a set of stop buttons, said stop buttons being on the housing and consisting of at least two buttons on respective opposite sides of the pivot pin, said two buttons having positions of releasable engagement with respective side edges of the leg when the bracket is in said first position, and being in confining restricting relationship with opposite respective side edges of said one leg when the bracket is in said second position.

4. A cosmetic accessory device as in claim 3 wherein said aperture is an elongated slot.

5. A cosmetic accessory device as in claim 4 wherein said set of stop buttons includes a third button, said bracket when in said first position being in releasably retained relationship with the first two identified buttons, said bracket having a third position in releasably retained relationship with all three buttons.

6. A cosmetic accessory device as in claim 3 wherein there are two sets of stop buttons, namely one for each of said legs and located on corresponding opposite sidewall structures.

* * * * *